US011926914B1

(12) United States Patent
Yang et al.

(10) Patent No.: US 11,926,914 B1
(45) Date of Patent: Mar. 12, 2024

(54) TUNGSTEN ELECTRODE FOR MOLTEN SALT ELECTROLYSIS FOR RARE EARTH METALS PREPARATION, AND PREPARATION METHOD THEREOF

(71) Applicant: Ganzhou Chenguang Rare Earths New Material Co., Ltd, Ganzhou (CN)

(72) Inventors: Shaohua Yang, Ganzhou (CN); Zhenhong Cui, Ganzhou (CN); Hui Li, Ganzhou (CN); Senlin Ouyang, Ganzhou (CN); Yao Xie, Ganzhou (CN); Fangsong He, Ganzhou (CN); Guangdong Wu, Ganzhou (CN); Kangwei Xie, Ganzhou (CN)

(73) Assignee: Ganzhou Chenguang Rare Earths New Material Co., Ltd., Ganzhou (CN)

( * ) Notice: Subject to any disclaimer, the term of this patent is extended or adjusted under 35 U.S.C. 154(b) by 0 days.

(21) Appl. No.: 18/238,877

(22) Filed: Aug. 28, 2023

(30) Foreign Application Priority Data

Mar. 17, 2023 (CN) ..... 2023102598589

(51) Int. Cl.
*C25C 7/02* (2006.01)
*C25C 1/22* (2006.01)

(52) U.S. Cl.
CPC . *C25C 7/02* (2013.01); *C25C 1/22* (2013.01)

(58) Field of Classification Search
None
See application file for complete search history.

(56) References Cited

FOREIGN PATENT DOCUMENTS

| | | | | |
|---|---|---|---|---|
| CN | 85104858 | A | | 1/1987 |
| CN | 106978613 | A | | 7/2017 |
| CN | 115776921 | A | * | 3/2023 |

OTHER PUBLICATIONS

Matsuda CN 115776921 A, machine translation (Year: 2023).*
CN State Intellectual Property Office; First Office Action Notification for CN Application No. 202310259858.9; dated Jul. 25, 2023; English translation of same.

* cited by examiner

*Primary Examiner* — Wojciech Haske
(74) *Attorney, Agent, or Firm* — Kirk A. Wilson; Joseph T. Guy; Patent Filing Specialist Inc.

(57) ABSTRACT

Provided is a tungsten electrode for molten salt electrolysis for rare earth metals preparation, including an open tungsten shell and a copper alloy body; wherein the copper alloy body is arranged inside the open tungsten shell; a tungsten buffer layer is provided between a side wall of the copper alloy body and the open tungsten shell; and a bottom of the copper alloy body is in contact with an inner bottom of the open tungsten shell.

15 Claims, 1 Drawing Sheet

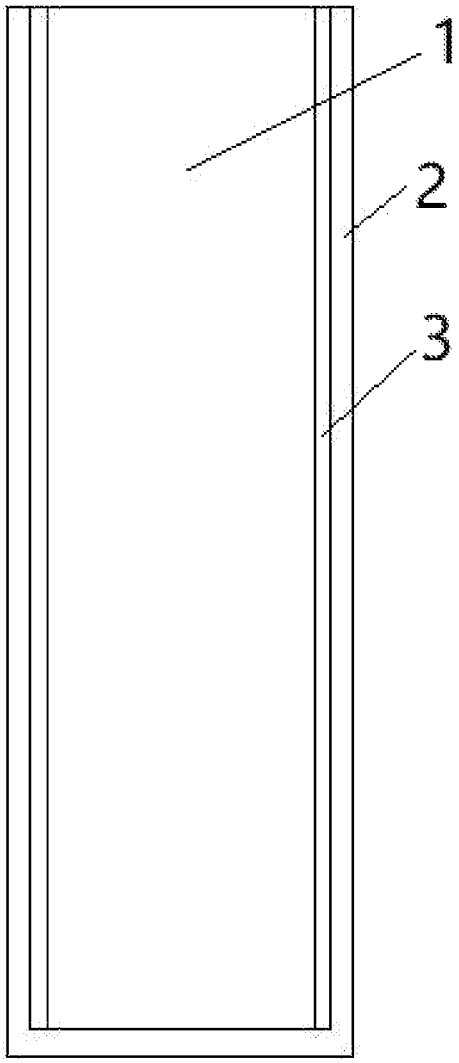
1
2
3

TUNGSTEN ELECTRODE FOR MOLTEN SALT ELECTROLYSIS FOR RARE EARTH METALS PREPARATION, AND PREPARATION METHOD THEREOF

CROSS REFERENCE TO RELATED APPLICATION

This patent application claims the benefit and priority of Chinese Patent Application No. 2023102598589 filed with the China National Intellectual Property Administration on Mar. 17, 2023, the disclosure of which is incorporated by reference herein in its entirety as part of the present application.

TECHNICAL FIELD

The present disclosure belongs to the technical field of rare earth metal electrolysis, and in particular relates to a tungsten electrode for molten salt electrolysis for rare earth metals preparation, and a preparation method thereof.

BACKGROUND

Rare earth metals are mainly used for the production of high-performance rare earth-based permanent magnet materials, which are important basic raw materials in the fields such as electronic information, new energy vehicles, and novel materials. The production of rare earth metals is mainly based on molten salt electrolysis. The molten salt electrolysis mainly includes two types according to different electrolyte systems. One is a rare earth chloride electrolysis system, that is, a binary electrolyte system, such as $RECl_3$—KCl (with RE being a rare earth metal). The other is a fluoride-oxide electrolyte system, that is, a ternary system, such as $RE_2O_3$-$REF_3$-LiF. For the rare earth chloride electrolysis system, a chloride molten salt has strong volatility, and the rare earth metal has high solubility in the chloride molten salt, resulting in high power consumption, low current efficiency, and poor yield. The fluoride-oxide electrolyte system has high current efficiency and stable raw materials, and is currently the main electrolyte system for molten salt electrolysis.

For the fluoride-oxide electrolyte system, during the electrolysis, the raw material rare earth oxides dissociate into rare earth cations and oxygen anions. Under the effect of a direct current electric field, the rare earth cations move to the cathode, where they attain electrons and are reduced to rare earth metals. The oxygen anions move towards the anode, where they lose electrons to generate oxygen.

However, the cathode is generally made of expensive tungsten metal. On the one hand, the tungsten metal has a higher density, resulting in a high mass of traditional tungsten electrodes. On the other hand, since the tungsten electrode has high resistance and poor conductivity, there is high power consumption on the tungsten cathode.

SUMMARY

An object of the present disclosure is to provide a tungsten electrode for molten salt electrolysis for rare earth metals preparation, and a preparation method thereof. In the present disclosure, the tungsten electrode has light weight and excellent conductivity, thereby reducing power consumption on the tungsten electrode.

To achieve the above object, the present disclosure provides the following technical solutions.

The present disclosure provides a tungsten electrode for molten salt electrolysis for rare earth metals preparation, including an open tungsten shell and a copper alloy body; wherein the copper alloy body is arranged inside the open tungsten shell;

a tungsten buffer layer is provided between a side wall of the copper alloy body and the open tungsten shell; and a bottom of the copper alloy body is in contact with an inner bottom of the open tungsten shell.

In some embodiments, the copper alloy body includes at least one selected from the group consisting of a copper-vanadium alloy body and a copper-niobium alloy body.

In some embodiments, an amount of vanadium in the copper-vanadium alloy body is 5% to 15% by mass; and an amount of niobium in the copper-niobium alloy body is 3% to 20% by mass.

In some embodiments, the open tungsten shell has an outer diameter of 65 mm to 120 mm and an inner diameter of 40 mm to 70 mm; and a bottom of the open tungsten shell has a thickness of 10 mm to 20 mm.

In some embodiments, the copper alloy body has a diameter of 20 mm to 60 mm; and the tungsten buffer layer has a thickness of 3 mm to 8 mm.

In some embodiments, the open tungsten shell has a density of not less than 18 $g/cm^3$; and the tungsten buffer layer has a density of 12 $g/cm^3$ to 14 $g/cm^3$.

The present disclosure further provides a method for preparing the tungsten electrode for molten salt electrolysis for rare earth metals preparation, including the following steps:

placing the copper alloy body inside the open tungsten shell;

adding a tungsten powder between the copper alloy body and the open tungsten shell to obtain a preform, and pressing the preform to obtain an electrode blank; wherein a central axis of the copper alloy body coincides with a central axis of the open tungsten shell; and forging the electrode blank to obtain the tungsten electrode for molten salt electrolysis for rare earth metals preparation.

In some embodiments, the pressing is conducted at a pressure of 50 MPa to 80 MPa for 2 h to 5 h.

In some embodiments, the forging is conducted at a temperature of 1,000° C. to 1,500° C.

The present disclosure provides a tungsten electrode for molten salt electrolysis for rare earth metals preparation, including an open tungsten shell and a copper alloy body; wherein the copper alloy body is arranged inside the open tungsten shell; a tungsten buffer layer is provided between a side wall of the copper alloy body and the open tungsten shell; and a bottom of the copper alloy body is in contact with an inner bottom of the open tungsten shell. In the present disclosure, the copper alloy body is used as a core of the tungsten electrode to replace a part of the tungsten metal. On the one hand, an overall mass of the tungsten electrode could be reduced. On the other hand, a conductivity of the tungsten electrode could be further improved, and power consumption on the tungsten electrode could be reduced. In addition, the tungsten buffer layer is arranged between the copper alloy body and the tungsten shell, thereby avoiding damages to the tungsten shell caused by linear expansion of the copper alloy body during applications. In this way, an overall stability of the tungsten electrode is improved.

BRIEF DESCRIPTION OF THE DRAWINGS

Figure shows a schematic structural view of a cross-section of the tungsten electrode for molten salt electrolysis for rare earth metals preparation according to an embodiment of the present disclosure, in which 1 represents the copper alloy body, 2 represents the open tungsten shell, and 3 represents the tungsten buffer layer.

DETAILED DESCRIPTION OF THE EMBODIMENTS

The present disclosure provides a tungsten electrode for molten salt electrolysis for rare earth metals preparation, including an open tungsten shell and a copper alloy body; wherein the copper alloy body is arranged inside the open tungsten shell;

a tungsten buffer layer is provided between a side wall of the copper alloy body and the open tungsten shell; and a bottom of the copper alloy body is in contact with an inner bottom of the open tungsten shell.

In the present disclosure, Figure shows a schematic structural view of a cross-section of the tungsten electrode for molten salt electrolysis for rare earth metals preparation, in which 1 represents the copper alloy body, 2 represents the open tungsten shell, and 3 represents the tungsten buffer layer.

In some embodiments, the copper alloy body includes at least one selected from the group consisting of a copper-vanadium alloy body and a copper-niobium alloy body.

In some embodiments, the copper alloy body has a purity of greater than 99.9%. In some embodiments, an amount of vanadium in the copper-vanadium alloy is 5% to 15% by mass, preferably 8% to 13%, and more preferably 10% to 12%. In some embodiments, an amount of niobium in the copper-niobium alloy body is 3% to 20% by mass, preferably 5% to 18%, and more preferably 10% to 15%. In some embodiment, the copper alloy body has uniform composition and no segregation inclusions.

In some embodiments, the copper alloy body has a diameter of 20 mm to 60 mm, preferably 25 mm to 55 mm, more preferably 30 mm to 50 mm.

In some embodiments, the copper alloy body has a same length as that of a cavity of the open tungsten shell.

In some embodiments, the open tungsten shell has an outer diameter of 65 mm to 120 mm. In some embodiments, the open tungsten shell has an inner diameter of 40 mm to 70 mm. In some embodiments, the open tungsten shell has a length of 700 mm to 1,100 mm. In some embodiments, a bottom of the open tungsten shell has a thickness of 10 mm to 20 mm, preferably 12 mm to 18 mm, more preferably 13 mm to 15 mm.

In some embodiments, the open tungsten shell is obtained through preparation. In some embodiments, the open tungsten shell is prepared by a method including the following steps:

putting a tungsten powder into a mold and molding to obtain a molded product, and subjecting the molded product to pressing, sintering, and forging sequentially to obtain the open tungsten shell.

In some embodiments of the present disclosure, the tungsten powder has a purity of greater than 99%. In some embodiments, the tungsten powder has a particle size D50 of 6 μm. There is no special limitation on a molding process, a process well known to those skilled in the art may be used.

In some embodiments, the pressing is conducted at a pressure of 200 MPa to 240 MPa, preferably 210 MPa to 230 MPa, and more preferably 220 MPa. In some embodiments, the pressing is conducted for 22 h to 24 h, preferably 23 h. In some embodiments, the pressing is conducted in an isostatic press. There is no special limitation on a pressing process, a process well known to those skilled in the art may be used.

In some embodiments, the sintering is conducted in a hydrogen atmosphere. In some embodiments, the sintering is conducted at a temperature of 2,200° C. to 2,350° C., preferably 2,250° C. to 2,300° C. In some embodiments, the sintering is conducted for 18 h to 22 h, preferably 19 h to 21 h, and more preferably 20 h. In some embodiments, the temperature for the sintering is obtained by heating at a rate of 10° C./min to 12° C./min. In some embodiments, after the sintering is completed, a resulting product is cooled. In some embodiments, the cooling is performed by natural cooling to a room temperature in a hydrogen atmosphere. In some embodiments, the sintering is conducted in an atmosphere sintering furnace.

In some embodiments, the forging is conducted at a temperature of 1,300° C. to 1,500° C., preferably at 1,350° C. to 1,450° C., and more preferably at 1,400° C. There is no special limitation on a forging process, a process well known to those skilled in the art may be used.

In some embodiments, after the forging is completed, a resulting product is straightened and polished. There is no special limitation on a straightening process, a process well known to those skilled in the art may be used. There is no special limitation on a polishing process, a process well known to those skilled in the art may be used as long as a thickness tolerance of the product could be controlled within 0.1 mm to 0.5 mm.

In some embodiments, the open tungsten shell has a density of not less than 18 g/cm$^3$.

In some embodiments, the tungsten buffer layer has a thickness of 3 mm to 8 mm, preferably 4 mm to 7 mm, and more preferably 5 mm to 6 mm. In some embodiments, the tungsten buffer layer has a density of 12 g/cm$^3$ to 14 g/cm$^3$, preferably 13 g/cm$^3$. In the present disclosure, the tungsten buffer layer could avoid damages to the tungsten shell caused by linear expansion of the copper alloy body during practical applications, thereby improving an overall stability of the tungsten electrode.

The present disclosure further provides a method for preparing the tungsten electrode for molten salt electrolysis for rare earth metals preparation, including the following steps:

placing the copper alloy body inside the open tungsten shell;

adding a tungsten powder between the copper alloy body and the open tungsten shell to obtain a preform, and pressing the preform to obtain an electrode blank; wherein a central axis of the copper alloy body coincides with a central axis of the open tungsten shell; and forging the electrode blank to obtain the tungsten electrode for molten salt electrolysis for rare earth metals preparation.

In the present disclosure, unless otherwise specified, all raw materials for preparation are commercially available products well known to those skilled in the art.

In some embodiments, the copper alloy body is placed inside the open tungsten shell, a tungsten powder is added between the copper alloy body and the open tungsten shell to obtain a preform, and the preform is pressed to obtain an electrode blank; where a central axis of the copper alloy body coincides with a central axis of the open tungsten shell.

In the present disclosure, the tungsten powder is the same as the tungsten powder described in the above technical solution, and will not be repeated here.

In some embodiments, the pressing is conducted at a pressure of 50 MPa to 80 MPa, preferably 55 MPa to 75 MPa, more preferably 60 MPa to 70 MPa. In some embodiments, the pressing is conducted for 2 h to 5 h, preferably 3 h to 4 h. In some embodiments, the pressing is conducted in an isostatic press. There is no special limitation on a pressing process, a process well known to those skilled in the art may be used.

In some embodiments, the electrode blank is forged to obtain the tungsten electrode for molten salt electrolysis for rare earth metals preparation.

In some embodiments, the forging is conducted at a temperature of 1,000° C. to 1,500° C., preferably at 1,100° C. to 1,400° C., and more preferably at 1,200° C. to 1,300° C. There is no special limitation on a forging process, a process well known to those skilled in the art may be used.

In some embodiments, after the forging is completed, a resulting product is straightened and polished. There is no special limitation on a straightening process, a process well known to those skilled in the art may be used. There is no special limitation on a polishing process, a process well known to those skilled in the art may be used as long as a thickness tolerance of the product could be controlled within 0.03 mm to 0.1 mm.

In order to further illustrate the present disclosure, the tungsten electrode for molten salt electrolysis for rare earth metals preparation, and the preparation method thereof provided by the present disclosure are described in detail below with reference to the accompanying drawings and examples, but the accompanying drawings and the examples should not be construed as limiting the protection scope of the present disclosure.

Example 1

A tungsten powder (with a purity of greater than 99% and a particle size D50 of 6 μm) was put into a mold and subjected to molding to obtain a molded product, and the molded product was pressed in an isostatic press at 220 MPa for 22 h. A resulting blank was placed in an atmosphere sintering furnace, and sintered by heating the blank to a temperature of 2,300° C. in a hydrogen atmosphere at a rate of 12° C./min and keeping the temperature for 22 h. After the sintering was completed, a resulting sintered product was naturally cooled to a room temperature in a hydrogen atmosphere, then heated to 1,500° C. and subjected to forging. After the forging was completed, a resulting forged product was straightened and polished (a thickness tolerance was controlled within 0.1 mm to 0.5 mm), to obtain an open tungsten shell (with a density of 18.1 g/cm$^3$, an outer diameter of 84 mm, a length of 800 mm, a wall thickness of 15 mm, and a bottom thickness of 20 mm).

A copper-vanadium alloy body (having a purity of greater than 99.9% and an amount of vanadium of 8% by mass) with a length of 780 mm and a diameter of 44 mm was placed into the open tungsten shell (where a central axis of the copper-vanadium alloy coincided with a central axis of the open tungsten shell). A tungsten powder (with a purity of greater than 99% and a particle size D50 of 6 μm) was added between the copper alloy body and the tungsten shell at a thickness of 5 mm to obtain a perform. The preform was put into an isostatic press and pressed at 60 MPa for 3 h to obtain an electrode blank.

The electrode blank was forged at 1,350° C., and then straightened and polished (a thickness tolerance was controlled within 0.03 mm to 0.1 mm) to obtain a tungsten electrode (having a diameter of 80 mm, a length of 800 mm, and a tungsten buffer layer with a density of 13 g/cm$^3$).

Example 2

A tungsten powder (with a purity of greater than 99% and a particle size D50 of 6 μm) was put into a mold and subjected to molding to obtain a molded product, and the molded product was pressed in an isostatic press at 230 MPa for 20 h. A resulting blank was placed in an atmosphere sintering furnace, and sintered by heating the blank to a temperature of 2,300° C. in a hydrogen atmosphere at a rate of 12° C./min and keeping the temperature for 23 h. After the sintering was completed, a resulting sintered product was naturally cooled to a room temperature in a hydrogen atmosphere then heated to 1,500° C. and subjected to forging. After the forging was completed, a resulting forged product was straightened and polished (a thickness tolerance was controlled within 0.1 mm to 0.5 mm), to obtain an open tungsten shell (with a density of 18.0 g/cm$^3$, an outer diameter of 105 mm, a length of 930 mm, a wall thickness of 18 mm, and a bottom thickness of 20 mm).

A copper-niobium alloy body (having a purity of greater than 99.9% and an amount of niobium of 10% by mass) with a length of 910 mm and a diameter of 57 mm was placed into the open tungsten shell (where a central axis of the copper-niobium alloy coincided with a central axis of the open tungsten shell). A tungsten powder (with a purity of greater than 99% and a particle size D50 of 6 μm) was added between the copper alloy body and the tungsten shell at a thickness of 6 mm to obtain a perform. The preform was put into an isostatic press and pressed at 70 MPa for 5 h to obtain an electrode blank.

The electrode blank was forged at 1,400° C., and then straightened and polished (a thickness tolerance was controlled within 0.03 mm to 0.1 mm) to obtain a tungsten electrode (having a diameter of 100 mm, a length of 930 mm, and a tungsten buffer layer with a density of 14 g/cm$^3$).

Example 3

A tungsten powder (with a purity of greater than 99% and a particle size D50 of 6 μm) was put into a mold and subjected to molding to obtain a molded product, and the molded product was pressed in an isostatic press at 220 MPa for 22 h. A resulting blank was placed in an atmosphere sintering furnace, and sintered by heating the blank to a temperature of 2,200° C. in a hydrogen atmosphere at a rate of 10° C./min and keeping the temperature for 22 h. After the sintering was completed, a resulting sintered product was naturally cooled to a room temperature in a hydrogen atmosphere, then heated to 1,500° C. and subjected to forging. After the forging was completed, a resulting forged product was straightened and polished (a thickness tolerance was controlled within 0.1 mm to 0.5 mm), to obtain an open tungsten shell (with a density of 18.2 g/cm$^3$, an outer diameter of 78 mm, a length of 750 mm, a wall thickness of 14 mm, and a bottom thickness of 15 mm).

A copper-niobium alloy body (having a purity of greater than 99.9% and an amount of niobium of 8% by mass) with a length of 735 mm and a diameter of 42 mm was placed into the open tungsten shell (where a central axis of the copper-niobium alloy coincided with a central axis of the open tungsten shell). A tungsten powder (with a purity of greater than 99% and a particle size D50 of 6 μm) was added between the copper alloy body and the tungsten shell at a thickness of 4 mm to obtain a perform. The preform was put into an isostatic press and pressed at 50 MPa for 2 h to obtain an electrode blank.

The electrode blank was forged at 1,300° C., and then straightened and polished (a thickness tolerance was controlled within 0.03 mm to 0.1 mm) to obtain a tungsten electrode (having a diameter of 75 mm, a length of 750 mm, and a tungsten buffer layer with a density of 12 g/cm$^3$).

Performance Testing

Test Example 1

The mass of the tungsten electrodes obtained in Examples 1 to 3 are shown in Table 1.

TABLE 1

Mass of the tungsten electrodes obtained in Examples 1 to 3

| Example No. | Mass/ kg | Mass of pure tungsten electrode with the same size/kg |
|---|---|---|
| Example 1 | 52 | 68 |
| Example 2 | 112 | 141 |
| Example 3 | 50 | 64 |

It can be seen from Table 1 that, compared with the traditional pure tungsten electrode with the same size, the mass of the tungsten electrode provided in the present disclosure is greatly reduced.

Test Example 2

The resistance of the tungsten electrodes obtained in Examples 1 to 3 was tested, and the test results are shown in Table 2.

TABLE 2

Resistance of the tungsten electrodes obtained in Examples 1 to 3

| Example No. | Resistance/ $*10^6$ Ω | Resistance of pure tungsten electrode with the same size/$*10^6$ Ω |
|---|---|---|
| Example 1 | 20.4 | 34 |
| Example 2 | 20.1 | 31 |
| Example 3 | 20.1 | 36 |

It can be seen from Table 2 that, compared with the traditional pure tungsten electrode with the same size, the conductivity of the tungsten electrode provided in the present disclosure is improved.

Test Example 3

The tungsten electrodes obtained in Examples 1 to 3 and pure tungsten electrode were used as a cathode respectively, graphite was used as an anode, and $Pr(Nd)_2O_3$—$Pr(Nd)F_3$—LiF was used as an electrolyte system. A test of a molten salt electrolysis for preparing rare earth metals was conducted at an electrolysis temperature of 1,100° C., a current intensity of 6,000 A to 8,000 A, so as to test a cathode voltage drop. The test results are shown in Table 3.

TABLE 3

Cathode voltage drop of the tungsten electrodes obtained in Examples 1 to 3 and pure tungsten electrode

| Example No. | Voltage drop/V | Voltage drops of pure tungsten electrode with the same size/V |
|---|---|---|
| Example 1 | 0.11 | 0.2 |
| Example 2 | 0.16 | 0.25 |
| Example 3 | 0.12 | 0.21 |

It can be seen from Table 3 that, compared with the traditional pure tungsten electrode with the same size, the tungsten electrode provided in the present disclosure has lower voltage drop.

Although the present disclosure is described in detail in conjunction with the foregoing embodiments, they are only a part of, not all of, the embodiments of the present disclosure. Other embodiments may be obtained based on these embodiments without creative efforts, and all of these embodiments shall fall within the protection scope of the present disclosure.

What is claimed is:

1. A tungsten electrode for molten salt electrolysis for rare earth metals preparation, comprising an open tungsten shell and a copper alloy body; wherein the copper alloy body is arranged inside the open tungsten shell;

a tungsten buffer layer is provided between a side wall of the copper alloy body and the open tungsten shell;

the tungsten buffer layer has a thickness of 3 mm to 8 mm;

the tungsten buffer layer has a density of 12 g/cm$^3$ to 14 g/cm$^3$; and a bottom of the copper alloy body is in contact with an inner bottom of the open tungsten shell.

2. The tungsten electrode according to claim 1, wherein the copper alloy body comprises at least one selected from the group consisting of a copper-vanadium alloy body and a copper-niobium alloy body.

3. The tungsten electrode according to claim 2, wherein an amount of vanadium in the copper-vanadium alloy body is 5% to 15% by mass; and an amount of niobium in the copper-niobium alloy body is 3% to 20% by mass.

4. The tungsten electrode according to claim 1, wherein the open tungsten shell has an outer diameter of 65 mm to 120 mm and an inner diameter of 40 mm to 70 mm; and a bottom of the open tungsten shell has a thickness of 10 mm to 20 mm.

5. The tungsten electrode according to claim 4, wherein the copper alloy body has a diameter of 20 mm to 60 mm.

6. The tungsten electrode according to claim 1, wherein the copper alloy body has a diameter of 20 mm to 60 mm.

7. The tungsten electrode according to claim 1, wherein the open tungsten shell has a density of not less than 18 g/cm$^3$.

8. A method for preparing the tungsten electrode for molten salt electrolysis for rare earth metals preparation according to claim 1, comprising the following steps:

placing the copper alloy body inside the open tungsten shell;

adding a tungsten powder between the copper alloy body and the open tungsten shell to obtain a preform, and pressing the preform to obtain an electrode blank; wherein a central axis of the copper alloy body coincides with a central axis of the open tungsten shell; and forging the electrode blank to obtain the tungsten electrode for molten salt electrolysis for rare earth metals preparation.

9. The method according to claim 8, wherein the pressing is conducted at a pressure of 50 MPa to 80 MPa for 2 h to 5 h.

10. The method according to claim 8, wherein the forging is conducted at a temperature of 1,000° C. to 1,500° C.

11. The method according to claim 8, wherein the copper alloy body comprises at least one selected from the group consisting of a copper-vanadium alloy body and a copper-niobium alloy body.

12. The method according to claim 11, wherein an amount of vanadium in the copper-vanadium alloy body is 5% to 15% by mass; and an amount of niobium in the copper-niobium alloy body is 3% to 20% by mass.

13. The method according to claim 8, wherein the open tungsten shell has an outer diameter of 65 mm to 120 mm and an inner diameter of 40 mm to 70 mm; and a bottom of the open tungsten shell has a thickness of 10 mm to 20 mm.

14. The method according to claim 8, wherein the copper alloy body has a diameter of 20 mm to 60 mm.

15. The method according to claim 8, wherein the open tungsten shell has a density of not less than 18 g/cm$^3$.

* * * * *